US007445565B2

(12) United States Patent
Komatsu

(10) Patent No.: US 7,445,565 B2
(45) Date of Patent: Nov. 4, 2008

(54) MULTI-PIECE SOLID GOLF BALL

(75) Inventor: Atsushi Komatsu, Chichibu (JP)

(73) Assignee: Bridgestone Sports Co., Ltd, Tokyo (JP)

( * ) Notice: Subject to any disclaimer, the term of this patent is extended or adjusted under 35 U.S.C. 154(b) by 0 days.

(21) Appl. No.: 11/606,980

(22) Filed: Dec. 1, 2006

(65) Prior Publication Data

US 2008/0132358 A1 Jun. 5, 2008

(51) Int. Cl.
*A63B 37/06* (2006.01)

(52) U.S. Cl. ..... 473/373

(58) Field of Classification Search ..... 473/373, 473/368, 374

See application file for complete search history.

(56) References Cited

U.S. PATENT DOCUMENTS

| | | | | |
|---|---|---|---|---|
| 5,184,828 | A | 2/1993 | Kim et al. | |
| 5,306,760 | A | 4/1994 | Sullivan | |
| 5,312,857 | A | 5/1994 | Sullivan | |
| 5,792,009 | A * | 8/1998 | Maruko | 473/359 |
| 5,830,085 | A | 11/1998 | Higuchi et al. | |
| 6,561,925 | B2 | 5/2003 | Watanabe et al. | |
| 6,592,470 | B2 | 7/2003 | Watanabe et al. | |
| 6,666,780 | B2 | 12/2003 | Watanabe | |
| 6,679,791 | B2 | 1/2004 | Watanabe | |
| 6,702,694 | B1 | 3/2004 | Watanabe | |
| 7,048,649 | B1 | 5/2006 | Watanabe et al. | |
| 7,066,836 | B2 | 6/2006 | Hayashi | |
| 2002/0055400 | A1 | 5/2002 | Higuchi et al. | |
| 2004/0106474 | A1 | 6/2004 | Hayashi et al. | |
| 2005/0170910 | A1 * | 8/2005 | Hayashi | 473/371 |
| 2006/0128504 | A1 | 6/2006 | Watanabe et al. | |
| 2006/0178231 | A1 | 8/2006 | Kasashima | |
| 2006/0270492 | A1 | 11/2006 | Higuchi et al. | |

FOREIGN PATENT DOCUMENTS

| | | | |
|---|---|---|---|
| JP | 2614791 | B2 | 2/1997 |
| JP | 2002-764 | A | 1/2002 |
| JP | 2002-765 | A | 1/2002 |
| JP | 2002-315848 | A | 10/2002 |
| JP | 3505922 | B2 | 12/2003 |
| JP | 3685245 | B2 | 6/2005 |
| JP | 3685248 | B2 | 6/2005 |
| JP | 2005-218858 | A | 8/2005 |
| WO | WO 98/46671 | A1 | 10/1998 |

* cited by examiner

*Primary Examiner*—Raeann Trimiew
(74) *Attorney, Agent, or Firm*—Sughrue Mion, PLLC

(57) ABSTRACT

The invention provides a multi-piece solid golf ball having a rubber-based core encased by, in order, an intermediate layer and a cover. The core contains from 0.05 to 0.5 part by weight of sulfur per 100 parts by weight of the rubber base, has a hardness difference between the surface and center thereof, expressed in JIS-C hardness units, of at least 21 but not more than 30, and has a diameter of from 36 to 40 mm. The intermediate layer has a Shore D hardness of at least 47 but not more than 60, and a thickness of from 0.5 to 2.0 mm. The cover has a Shore D hardness of at least 53 but not more than 60, and a thickness of from 0.6 to 1.5 mm. The intermediate layer and cover satisfy the following condition: 120≦(Shore D hardness of intermediate layer×thickness of intermediate layer)+(Shore D hardness of cover×thickness of cover)≦150. The golf ball of the invention has, in particular, an excellent feel on impact and an excellent flight performance on shots taken with an iron.

7 Claims, No Drawings

MULTI-PIECE SOLID GOLF BALL

BACKGROUND OF THE INVENTION

The present invention relates to a multi-piece solid golf ball composed of a resilient core, an intermediate layer and a cover. More particularly, the invention relates to a golf ball having a good feel on impact and an improved distance on shots with an iron.

Golf balls having a multilayer structure, particularly a three-piece structure, can substantially increase the distance of travel compared with one-piece and two-piece golf balls, and are thus known to be beneficial to golfers. Such three-piece golf balls include golf balls in which the intermediate layer and cover are formed so as to be relatively soft (JP 3505922), golf balls in which the cover has been made relatively thick (JP 3685248), golf balls in which the cover has been made relatively hard (JP-A 2005-218858, JP 3685245), golf balls having a small core (JP 2614791), golf balls in which the core has a relatively high initial velocity (unpublished Japanese Patent Application No. 2005-367321), and three-piece solid golf balls endowed with various hardness and layer thickness designs, such as those described in JP-A 2002-764, JP-A 2002-765 and JP-A 2002-315848.

In the above golf balls, much importance is placed on the distance traveled by the ball on shots with a driver, but these balls are not designed to satisfy golfers in terms of the feel or distance achieved on shots hit with an iron. The behavior of the ball differs when it is hit with a driver as opposed to when it is hit with an iron having a large loft angle. When the ball is hit with a driver, the entire ball deforms. On the other hand, when the ball is hit with an iron, deformation occurs at the surface of the ball and the portion of the ball up to 2-3 mm from the surface, thus making the structure near the surface of the ball important.

In distance balls which have hitherto been developed so as to travel farther on shots taken with a driver, the ball is provided with a hard cover to increase the initial velocity on impact and lower the spin rate, but the feel and controllability of the ball on shots with an iron are diminished. Modifying the design of such prior-art distance golf balls by softening the cover so as to improve the ball performance on shots with an iron ends up increasing the spin rate when the ball is hit with a driver, which shortens the distance of travel.

Hence, there has existed a desire to develop and furnish to golfers a golf ball which travels a satisfactory distance on shots with a driver while reliably achieving the desired distance on shots with an iron, and which also has a good feel when played with an iron.

SUMMARY OF THE INVENTION

It is thus an object of the present invention to provide a multi-piece solid golf ball which achieves a satisfactory distance on shots with a driver yet also has an improved controllability, distance and feel on shots with an iron.

As a result of extensive investigations, the inventors have found that by providing the core with a large hardness gradient, the spin rate of the ball when hit with a driver is lowered, increasing the distance of travel. Moreover, the inventors have found that, with the use of ionomeric materials of a good rebound resilience in the intermediate layer and cover, even when the hardness of the cover is reduced to a moderate hardness, the ball takes on a low spin rate on shots with a driver and has an improved feel and distance on shots with an iron. This discovery led to the present invention.

Going into greater detail, distance balls, in which the distance traveled on shots taken with a driver is generally of greatest importance, leave something to be desired in terms of their feel and distance on shots taken with an iron. However, the present invention provides a multi-functional golf ball which serves as such a distance ball while also having a dramatically improved feel and distance on shots taken with an iron. This is achieved by using a cover of moderate hardness to improve controllability on shots with an iron. Although a moderately hard cover gives the ball a higher spin rate than a cover with a high hardness, it has been found in the present invention that a lower spin rate on shots with a driver is achieved by increasing the hardness gradient of the core, and that optimizing the hardness and gauge of the intermediate layer and cover enables the above decrease in spin rate to be achieved also when using an iron. Moreover, the inventors have found that the high rebound effects of a sulfur-containing core and of an intermediate layer and a cover formed of ionomer materials increase the initial velocity of the ball when hit with an iron, and optimization of the hardness and gauge provides a good feel on impact and an improved distance on shots with an iron.

Accordingly, the invention provides the following multi-piece solid golf balls.

[1] A multi-piece solid golf ball comprising a rubber-based core encased by, in order, an intermediate layer and a cover, wherein the core contains from 0.05 to 0.5 part by weight of sulfur per 100 parts by weight of the rubber base, has a hardness difference between a surface and a center of the core, expressed in JIS-C hardness units, of at least 21 but not more than 30, and has a diameter of from 36 to 40 mm; the intermediate layer has a Shore D hardness of at least 47 but not more than 60, and a thickness of from 0.5 to 2.0 mm; the cover has a Shore D hardness of at least 53 but not more than 60, and a thickness of from 0.6 to 1.5 mm; and the intermediate layer and cover satisfy the following condition:

$$120 \leq (\text{Shore } D \text{ hardness of intermediate layer} \times \text{thickness of intermediate layer}) + (\text{Shore } D \text{ hardness of cover} \times \text{thickness of cover}) \leq 150.$$

[2] The multi-piece solid golf ball of [1] which has a difference between core initial velocity and ball initial velocity, as measured by a method set forth in the Rules of Golf using an initial velocity measuring apparatus of the same type as the USGA drum rotation-type initial velocity instrument, which satisfies the condition:

$$(\text{initial velocity of core}) - (\text{initial velocity of ball}) < 0.$$

[3] The multi-piece solid golf ball of [1], wherein the intermediate layer and/or the cover is made of a heated mixture which is composed of:

(a) 100 parts by weight of an olefin-unsaturated carboxylic acid random copolymer and/or an olefin-unsaturated carboxylic acid-unsaturated carboxylic acid ester random copolymer, (b) from 5 to 80 parts by weight of a fatty acid and/or fatty acid derivative having a molecular weight of at least 280, and (c) from 0.1 to 10 parts by weight of a basic inorganic metal compound capable of neutralizing the acid groups in components (a) and (b), and which has a melt index of at least 1.0 dg/min.

[4] The multi-piece solid golf ball of [1], wherein the intermediate layer and/or the cover is made of a heated mixture which is composed of:

(d) 100 parts by weight of a metal ion neutralization product of an olefin-unsaturated carboxylic acid random copolymer and/or an olefin-unsaturated carboxylic acid-unsaturated carboxylic acid ester random copolymer, (b) from 5 to 80 parts by weight of a fatty acid and/or fatty acid derivative having a molecular weight of at least 280, and (c) from 0.1 to 10 parts by weight of a basic inorganic metal compound capable of neutralizing the acid groups in components (d) and (b), and which has a melt index of at least 1.0 dg/min.

[5] The multi-piece solid golf ball of [1], wherein the intermediate layer and/or the cover is made of a heated mixture which is composed of:

100 parts by weight of, in admixture, (a) an olefin-unsaturated carboxylic acid random copolymer and/or an olefin-unsaturated carboxylic acid-unsaturated carboxylic acid ester random copolymer and (d) a metal ion neutralization product of an olefin-unsaturated carboxylic acid random copolymer and/or an olefin-unsaturated carboxylic acid-unsaturated carboxylic acid ester random copolymer, (b) from 5 to 80 parts by weight of a fatty acid and/or fatty acid derivative having a molecular weight of at least 280, and (c) from 0.1 to 10 parts by weight of a basic inorganic metal compound capable of neutralizing the acid groups in components (d) and (b), and which has a melt index of at least 1.0 dg/min.

[6] The multi-piece solid golf ball of [1], wherein the core has a deflection when compressed under a final load of 1,275 N (130 kgf) from an initial load of 98 N (10 kgf) of from 3.0 to 4.5 mm.

DETAILED DESCRIPTION OF THE INVENTION

The golf ball of the invention is, as noted above, a multi-piece solid golf ball having a rubber-based core, an intermediate layer and a cover.

The core in the present invention is produced by a conventional method using a base rubber as the chief material. The core may be formed by, for example, blending 100 parts by weight of cis-1,4-polybutadiene with at least 10 parts by weight but not more than 60 parts by weight of one or a mixture of two or more crosslinking agents selected from among α,β-monoethylene-unsaturated carboxylic acids such as acrylic acid or methacrylic acid, metal ion neutralization products thereof and functional monomers such as trimethylolpropane methacrylate, at least 5 parts by weight but not more than 30 parts by weight of a filler such as zinc oxide or barium sulfate, at least 0.5 parts by weight but not more than 5 parts by weight of a peroxide such as dicumyl peroxide, and optionally at least 0 part by weight but not more than 1 part by weight of an antioxidant. The rubber composition is then crosslinked under applied pressure, and subsequently formed into a spherical shape by heating and compression at a temperature of at least 140° C. but not more than 170° C. for a period of at least 10 minutes but not more than 40 minutes.

It is critical for the base rubber of which the core is primarily composed to contain sulfur. This sulfur, while not subject to any particular limitation, may be in the form of a powder. For example, use may be made of a commercial product such as the zinc white-sulfur mixture produced by Tsurumi Chemical Industry Co., Ltd.

The amount of sulfur compounded per 100 parts by weight of the base rubber in the core is preferably at least 0.05 part by weight, and more preferably at least 0.1 part by weight. The upper limit is preferably not more than 0.5 part by weight, and more preferably not more than 0.3 part by weight. If the amount of sulfur included is too low, it may not be possible to attain more than a given hardness difference—that is, to attain more than a given hardness gradient—between the core surface and the core center. Conversely, if the amount of sulfur compounded is too much higher than the above range, cracks may tend to arise in the molded rubber core, or the core may fail to achieve sufficient hardness and may have a low rebound resilience.

To enhance the rebound of the golf ball, it is preferable to include also an organosulfur compound in the base rubber serving as the primary material of the core. Any organosulfur compound that can enhance the rebound of the golf ball may be used without particular limitation. Exemplary organosulfur compounds include thiophenols, thionaphthols, halogenated thiophenols, and metal salts thereof. Specific examples include pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol; and diphenylpolysulfides, dibenzylpolysulfides, dibenzoylpolysulfides, dibenzothiazoylpolysulfides and dithiobenzoylpolysulfides having 2 to 4 sulfurs. Diphenyldisulfide and the zinc salt of pentachlorothiophenol are especially preferred.

The amount of such organosulfur compounds included per 100 parts by weight of the base rubber is preferably at least 0.05 part by weight, more preferably at least 0.1 part by weight, and most preferably at least 0.2 part by weight. If too little organosulfur compound is included, a rebound improving effect cannot be expected. The upper limit amount is preferably not more than 5 parts by weight, more preferably not more than 4 parts by weight, and most preferably not more than 2 parts by weight. If too much organosulfur compound is included, the core may become too soft, possibly worsening the feel of the ball on impact and worsening the durability to cracking on repeated impact.

The core has a diameter of at least 36 mm but not more than 40 mm, and preferably at least 37 mm but not more than 39 mm. If the core diameter is smaller than the above range, the intermediate layer and cover will be thicker, which may worsen the feel on impact with an iron, especially when the ball is played with a middle iron or a long iron, in addition to which the spin rate will increase, shortening the distance traveled by the ball. If the core diameter is larger than the above range, the intermediate layer and cover will be thinner, resulting in an inferior durability to cracking and an inferior scuff resistance. Moreover, a thinner intermediate layer will lower the side spin-reducing effect. As a result, the ball will be more receptive to side spin on shots with an iron and thus have a poor controllability.

It is recommended that the core deflection when compressed under a final load of 130 kgf from an initial load of 10 kgf be optimized so as to increase the spin-reducing effect of the core on shots with an iron and to impart a good feel on impact. The core deflection under such compression is preferably at least 3.0 mm, and more preferably at least 3.3 mm, but preferably not more than 4.5 mm, and more preferably not more than 4.0 mm. If this value is too small, that is, if the core is too hard, the core deformation on impact with an iron may be inadequate, as a result of which a spin-reducing effect may not emerge and the feel on impact may be harder than desirable. Conversely, if the above value is too large, that is, if the core is too soft, the ball may undergo excessive deformation on impact with a driver and have a poor rebound.

The core has a surface hardness as expressed in JIS-C hardness units which, while not subject to any particular limitation, is preferably of at least 75, and more preferably at least 80, but preferably not more than 90, and more preferably not more than 85. At a core surface hardness greater than the above range, the ball may have a poor feel on impact and a poor durability to cracking. On the other hand, at a core surface hardness below the above range, the spin rate of the ball on shots taken with a driver or an iron may rise excessively.

The core has a center hardness as expressed in JIS-C hardness units which, while not subject to any particular limitation, is preferably at least 50, and more preferably at least 55, but is preferably not more than 65, and more preferably not more than 60. At a core center hardness greater than the above range, the hardness difference between the center and the surface becomes small, which may lead to an excessive rise in the spin rate of the ball on impact. On the other hand, at a core center hardness below the above range, the core may become too soft, lowering the rebound of the ball and its durability to cracking.

It is critical for the hardness difference between the surface and center of the core ((surface of core)−(center of core)), expressed in JIS-C hardness units, to be at least 21 but not more than 30, and preferably at least 23 but not more than 28. If this difference is too small, the spin rate will increase, shortening the distance of travel by the ball. On the other hand, if this difference is too large, the durability will worsen and a large decline will occur in the rebound of the ball.

No particular limitations are imposed on the materials of which the intermediate layer and/or cover are made, although it is preferable to use in each an ionomer. By using in this way an ionomer having a good rebound resilience in the intermediate layer and cover which are located closer to the surface, the initial velocity of the ball when hit with an iron increases.

It is more preferable to use as the intermediate layer and/or cover materials the following ionomer-containing mixed materials I to III.

Mixed Material I

A heated mixture which is composed of:

(a) 100 parts by weight of an olefin-unsaturated carboxylic acid random copolymer and/or an olefin-unsaturated carboxylic acid-unsaturated carboxylic acid ester random copolymer, (b) from 5 to 80 parts by weight of a fatty acid and/or fatty acid derivative having a molecular weight of at least 280, and (c) from 0.1 to 10 parts by weight of a basic inorganic metal compound capable of neutralizing the acid groups in components (a) and (b);

and which has a melt index of at least 1.0 dg/min.

Mixed Material II

A heated mixture which is composed of:

(d) 100 parts by weight of a metal ion neutralization product of an olefin-unsaturated carboxylic acid random copolymer and/or an olefin-unsaturated carboxylic acid-unsaturated carboxylic acid ester random copolymer, (b) from 5 to 80 parts by weight of a fatty acid and/or fatty acid derivative having a molecular weight of at least 280, and (c) from 0.1 to 10 parts by weight of a basic inorganic metal compound capable of neutralizing the acid groups in components (d) and (b);

and which has a melt index of at least 1.0 dg/min.

Mixed Material III

A heated mixture which is composed of:

100 parts by weight of a mixture of above components (a) and (d), (b) from 5 to 80 parts by weight of a fatty acid and/or fatty acid derivative having a molecular weight of at least 280, and (c) from 0.1 to 10 parts by weight of a basic inorganic metal compound capable of neutralizing the acid groups in components (d) and (b);

and which has a melt index of at least 1.0 dg/min.

The olefin in the above component (a) has a number of carbons which is generally at least 2 but not more than 8, and preferably not more than 6. Specific examples include ethylene, propylene, butene, pentene, hexene, heptene and octene. Ethylene is especially preferred.

Examples of the unsaturated carboxylic acid include acrylic acid, methacrylic acid, maleic acid and fumaric acid. Acrylic acid and methacrylic acid are especially preferred.

Moreover, the unsaturated carboxylic acid ester is preferably a lower alkyl ester of the above unsaturated carboxylic acid. Specific examples include methyl methacrylate, ethyl methacrylate, propyl methacrylate, butyl methacrylate, methyl acrylate, ethyl acrylate, propyl acrylate and butyl acrylate. Butyl acrylate (n-butyl acrylate, i-butyl acrylate) is especially preferred.

The random copolymer of component (a) may be obtained by random copolymerizing the above components in accordance with a known method. Here, it is recommended that the unsaturated carboxylic acid content (acid content) present in the random copolymer be generally at least 2 wt %, preferably at least 6 wt %, and more preferably at least 8 wt %, but not more than 25 wt %, preferably not more than 20 wt %, and even more preferably not more than 15 wt %. At a low acid content, the material may have a lower resilience, whereas at a high acid content, the processability of the material may decrease.

The random copolymer neutralization product serving as component (d) can be obtained by neutralizing some of the acid groups on the above-described random copolymer with metal ions. Here, illustrative examples of the metal ions for neutralizing the acid groups include $Na^+$, $K^+$, $Li^+$, $Zn^{++}$, $Cu^{++}$, $Mg^{++}$, $Ca^{++}$, $Co^{++}$, $Ni^{++}$ and $Pb^{++}$. Of these, preferred use can be made of, for example, $Na^+$, $Li^+$, $Zn^{++}$ and $Mg^{++}$. The use of $Zn^{++}$ is even more preferred. No particular limitation is imposed on the degree to which such metal ions neutralize the random copolymer. Such a neutralization product may be obtained by a known method. For example, a compound such as a formate, acetate, nitrate, carbonate, bicarbonate, oxide, hydroxide or alkoxide of the above-mentioned metal ions may be used to introduce the metal ions to the above-described random copolymer.

Illustrative examples of the random copolymers that may be used as above component (a) include Nucrel AN4311, Nucrel AN4318 and Nucrel 1560 (all products of DuPont-Mitsui Polychemicals Co., Ltd.). Illustrative examples of the random copolymer neutralization products that may be used as above component (d) include Himilan 1554, Himilan 1557, Himilan 1601, Himilan 1605, Himilan 1706, Himilan 1855, Himilan 1856 and Himilan AM7316 (all products of DuPont-Mitsui Polychemicals Co., Ltd.), and Surlyn 6320, Surlyn 7930 and Surlyn 8120 (all products of E.I. DuPont de Nemours & Co.). The use of a zinc-neutralized ionomer resin (e.g., Himilan AM7316) is especially preferred.

The random copolymer of above component (a) and/or the neutralization product of above component (d) may be used as the base resin. If both are used in combination, the proportions therebetween are not subject to any particular limitation.

Above component (b) is a fatty acid or fatty acid derivative having a molecular weight of at least 280. It is a component which improves the flow properties of the heated mixture. Compared with the thermoplastic resin serving as above component (a), this component has a very low molecular weight and helps to greatly increase the melt viscosity of the mixture. Because the fatty acid (or derivative thereof) of the invention has a molecular weight of at least 280 and includes a high content of acid groups (or derivatives thereof), the loss in resilience due to the addition thereof is small.

The fatty acid or fatty acid derivative of component (b) may be an unsaturated fatty acid (or derivative thereof) containing a double bond or triple bond on the alkyl moiety, or it may be a saturated fatty acid (or derivative thereof) in which the bonds on the alkyl moiety are all single bonds. It is recommended that the number of carbons on the molecule be generally at least 18, but not more than 80, and preferably not more than 40. Too few carbons may make it impossible to improve the heat resistance, which is an object of the invention, and may also make the acid group content so high as to diminish the flow-improving effect due to interactions with acid groups present in the base resin. On the other hand, too many carbons increases the molecular weight, as a result of which the flow-improving effect may diminish.

Specific examples of the fatty acid of component (b) include stearic acid, 1,2-hydroxystearic acid, behenic acid, oleic acid, linoleic acid, linolenic acid, arachidic acid and lignoceric acid. Of these, stearic acid, arachidic acid, behenic acid and lignoceric acid are preferred.

The fatty acid derivative in the invention is exemplified by metallic soaps in which the proton on the acid group of the fatty acid has been replaced with a metal ion. Examples of the metal ion include $Li^{+}$, $Ca^{+}$, $Mg^{++}$, $Zn^{++}$, $Mn^{++}$, $Al^{+++}$, $Ni^{++}$, $Fe^{++}$, $Fe^{+++}$, $Cu^{++}$, $Sn^{++}$, $Pb^{++}$ and $Co^{++}$. Of these, $Ca^{++}$, $Mg^{++}$ and $Zn^{++}$ are especially preferred.

Specific examples of fatty acid derivatives that may be used as component (b) include magnesium stearate, calcium stearate, zinc stearate, magnesium 1,2-hydroxystearate, calcium 1,2-hydroxystearate, zinc 1,2-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred.

Moreover, use may be made of known metal soap-modified ionomers (such as those mentioned in U.S. Pat. No. 5,312,857, U.S. Pat. No. 5,306,760 and International Application WO 98/46671) when using the above-described component (a) and/or (d) and component (b).

In the above-described material, a basic inorganic filler capable of neutralizing acid groups in above component (a) and/or (d) and in above component (b) may be added as component (c). However, as mentioned in the prior-art examples, when component (a) and/or (d) and component (b) alone, and in particular a metal-modified ionomer resin alone (e.g., a metal soap-modified ionomer resins mentioned in the above patent publications), is heated and mixed, as shown below, the metallic soap and un-neutralized acid groups present on the ionomer undergo exchange reactions, generating a fatty acid. Because the fatty acid has a low thermal stability and readily vaporizes during molding, it causes molding defects. Moreover, if the fatty acid thus generated deposits on the surface of the molded material, it may substantially lower paint film adhesion.

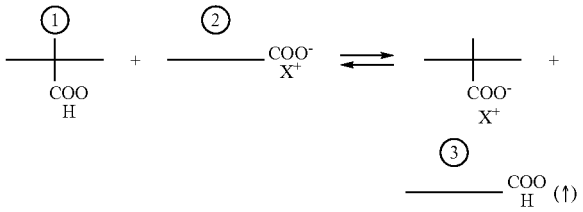

(1) un-neutralized acid group present on the ionomer resin
(2) metallic soap
(3) fatty acid
X: metal cation To solve this problem, the material includes also, as component (c), a basic inorganic metal compound which neutralizes the acid groups present in above components (a) and/or (d) and component (b). The inclusion of component (c) as an essential ingredient confers excellent properties. That is, the acid groups in above components (a) and/or (d) and component (b) are neutralized, and synergistic effects from the blending of each of these respective components increase the thermal stability of the heated mixture while at the same time conferring a good moldability and thus enhancing the resilience as a golf ball-forming material.

It is recommended that above component (c) be a basic inorganic metal compound, preferably a monoxide, which is capable of neutralizing acid groups in above components (a) and/or (d) and in component (b). Because such compounds have a high reactivity with the ionomer resin and the reaction by-products contain no organic matter, the degree of neutralization of the heated mixture can be increased without a loss of thermal stability.

The metal ions used here in the basic inorganic metal compound are exemplified by $Li^{+}$, $Na^{+}$, $K^{+}$, $Ca^{++}$, $Mg^{++}$, $Zn^{++}$, $Al^{+++}$, $Ni^{+}$, $Fe^{++}$, $Fe^{+++}$, $Cu^{++}$, $Mn^{++}$, $Sn^{++}$, $Pb^{++}$ and $Co^{++}$. Illustrative examples of the inorganic metal compound include basic inorganic fillers containing these metal ions, such as magnesium oxide, magnesium hydroxide, magnesium carbonate, zinc oxide, sodium hydroxide, sodium carbonate, calcium oxide, calcium hydroxide, lithium hydroxide and lithium carbonate. As noted above, a monoxide is preferred. The use of magnesium oxide, which has a high reactivity with ionomer resins, is especially preferred.

The above ionomer-based mixed material prepared as described above from components (a), (d), (b) and (c) can be provided with an improved thermal stability, moldability and resilience. To this end, these components must be formulated in certain proportions. Specifically, it is essential to include, per 100 parts by weight of component (a) and/or component (d) (referred to below as the "base resin"), at least 5 parts by weight, but not more than 80 parts by weight, preferably not more than 40 parts by weight, and more preferably not more than 20 parts by weight, of component (b); and at least 0.1 part by weight but not more than 10 parts by weight, and preferably not more than 5 parts by weight of component (c). Too little component (b) lowers the melt viscosity, resulting in a poor processability, whereas too much lowers the durability. Too little component (c) fails to improve thermal stability and resilience, whereas too much instead lowers the heat resistance of the composition due to the presence of excess basic inorganic metal compound.

The above mixed material may be used directly as is or other ingredients may be suitably formulated therein. In either case, the melt index of the material as a heated mixture, as measured according to JIS-K6760 at a temperature of 190°

C. and under a load of 21 N (2.16 kgf), is at least 1.0 dg/min, preferably at least 1.5 dg/min, and more preferably at least 2.0 dg/min. It is recommended that the upper limit in the melt index be not more than 20 dg/min, and preferably not more than 15 dg/min. If the heated mixture has a low melt index, the result will be a marked decline in melt processability.

It is preferable for the above mixed material to be characterized by, in infrared absorption spectroscopy, the relative absorbance at the absorption peak attributable to carboxylate stretching vibrations at 1530 to 1630 $cm^{-1}$ with respect to the absorbance at the absorption peak attributable to carbonyl stretching vibrations normally detected at 1690 to 1710 $cm^{-1}$. This ratio may be expressed as follows: (absorbance at absorption peak for carboxylate stretching vibrations)/(absorbance at absorption peak for carbonyl stretching vibrations).

Here, "carboxylate stretching vibrations" refers to vibrations by carboxyl groups from which the proton has dissociated (metal ion-neutralized carboxyl groups), and "carbonyl stretching vibrations" refers to vibrations by undissociated carboxyl groups. The ratio between these respective peak intensities depends on the degree of neutralization. In the ionomer resins having a degree of neutralization of about 50 mol % which are commonly used, the ratio between these peak absorbances is about 1:1.

To improve the thermal stability, moldability and resilience as a material, it is recommended that the above mixed material have a carboxylate stretching vibration peak absorbance which is at least 1.5 times, and preferably at least 2 times, the carbonyl stretching vibration peak absorbance. The absence of any carbonyl stretching vibration peak is especially preferred.

The thermal stability of the above mixed material. can be measured by thermogravimetry. It is recommended that, in thermogravimetry, the heated mixture have a weight loss at 250° C., based on the weight of the mixture at 25° C., of generally not more than 2 wt %, preferably not more than 1.5 wt %, and more preferably not more than 1 wt %.

Although not subject to any particular limitation, it is recommended that the specific gravity of the above mixed material be generally at least 0.9, but not more than 1.5, preferably not more than 1.3, and more preferably not more than 1.1.

The mixed material is obtained by heating and mixing the above-described component (a) and/or (d), component (b) and component (c), and has an optimized melt index. It is recommended that at least 70 mol%, preferably at least 80 mol%, and more preferably at least 90 mol%, of the acid groups in the heated mixture be neutralized. A high degree of neutralization makes it possible to more reliably suppress the exchange reactions that are a problem when only the above-described base resin and the fatty acid (or a derivative thereof) are used, thus preventing the formation of fatty acids. As a result, there can be obtained a material which has a greatly increased thermal stability and a good moldability, and which moreover has a much improved resilience compared with prior-art ionomer resins.

Here, with regard to the neutralization of the above mixed material, to more reliably achieve both a high degree of neutrality and good flow, it is recommended that the acid groups in the heated mixture be neutralized with transition metal ions and with alkali metal and/or alkaline earth metal ions. Transition metal ions have a weaker ionic cohesion than alkali metal and alkaline earth metal ions and so neutralize some of the acid groups in the heated mixture, enabling the flow properties to be significantly improved.

The molar ratio between the transition metal ions and the alkali metal and/or alkaline earth metal ions is set as appropriate, generally in a range of 10:90 to 90:10, and especially 20:80 to 80:20. Too low a molar ratio of transition metal ions may fail to provide sufficient improvement in the flow properties of the material. On the other hand, a molar ratio that is too high may lower the resilience.

Specific examples of such metal ions include zinc ions as the transition metal ions and at least one type of ion selected from among sodium, lithium and magnesium ions as the alkali metal or alkaline earth metal ions.

No particular limitation is imposed on the method used to obtain the heated mixture in which the acid groups have been neutralized with transition metal ions and alkali metal or alkaline earth metal ions. Specific examples of methods of neutralization with transition metal ions, particularly zinc ions, include a method in which a zinc soap is used as the fatty acid derivative, a method in which a zinc ion neutralization product is included as component (d) in the base resin (e.g., a zinc-neutralized ionomer resin), and a method in which zinc oxide is used as the basic inorganic metal compound of component (c).

Various additives may optionally be included in the above mixed material. For example, when the mixed material is to be used as a cover material, additives such as pigments, dispersants, antioxidants, ultraviolet absorbers and optical stabilizers may be included. In addition to the above essential components, to improve the feel of the golf ball on impact, the material of the invention may also include, as optional components, various non-ionomeric thermoplastic elastomers. Illustrative examples of such non-ionomeric thermoplastic elastomers include olefin elastomers, styrene elastomers, ester elastomers and urethane elastomers. The use of olefin elastomers and styrene elastomers is especially preferred.

The method of producing the intermediate layer or cover is not subject to any particular limitation. For example, to formulate the above-described material and obtain a cover material, mixture may be carried out under heating at 150 to 250° C. in an internal mixer such as a kneading-type twin-screw extruder, a Banbury mixer or a kneader. The method of incorporating the various additives other than the essential ingredients in the cover material, while not subject to any particular limitation, is exemplified by a method in which the additives are blended together with the essential ingredients and at the same time mixed under heating, and a method in which the essential ingredients are first mixed together under heating, following which the optional additives are added and further mixing under heating is carried out.

It is critical for the intermediate layer material to have a hardness, expressed as the Shore D hardness (the same value as that measured with a type D durometer in accordance with ASTM D2240) of at least 47 but not more than 60, and preferably at least 50 but not more than 58. If the intermediate layer is softer than the above hardness range, the spin rate will increase, reducing the distance traveled by the ball. Moreover, the rebound will decrease so that, particularly on shots taken with an iron, the initial velocity will be lower and the ball will fail to travel as far as expected. Conversely, if the intermediate layer is harder than the above range, the feel of the ball on impact will worsen.

The intermediate layer has a thickness of at least 0.5 mm but not more than 2.0 mm, preferably at least 0.8 mm but not more than 1.7 mm, and more preferably at least 1.0 mm but not more than 1.5 mm. If the intermediate layer is too much thinner than the above range, the durability to cracking may worsen. Moreover, on shots with an iron, the ball may readily take on side spin, resulting in a poor controllability. On the other hand, if the intermediate layer is thicker than the above range, the spin rate may increase and the feel on impact may worsen.

The cover is defined as the outermost layer which encases the intermediate layer and is positioned on the ball surface side. The cover material must have a hardness, expressed as the Shore D hardness, of at least 53 but not more than 60, and preferably at least 55 but not more than 59. If the cover is softer than the above hardness range, the spin rate may rise, lowering the distance traveled by the ball. Moreover, the rebound decreases and, particularly on shots taken with an iron, the initial velocity decreases, as a result of which the ball does not travel as far as expected. On the other hand, if the cover is harder than the above range, the feel of the ball on impact, particularly on shots taken with an iron, will worsen.

The cover thickness is set to at least 0.6 mm but not more than 1.5 mm, and preferably at least 0.8 mm but not more than 1.4 mm. If the cover is too much thinner than the above range, the durability of the ball to cracking and the scuff resistance will worsen. In addition, on shots with an iron, the ball tends to take on side spin, compromising the controllability. Conversely, if the cover is thicker than the above range, the spin rate will rise and the feel of the ball on impact may worsen.

In the practice of the invention, to optimize the hardnesses and thicknesses of the intermediate layer and the cover, it is essential to satisfy the following condition:

$$120 \leq (\text{Shore } D \text{ hardness of intermediate layer} \times \text{thickness of intermediate layer}) + (\text{Shore } D \text{ hardness of cover} \times \text{thickness of cover}) \leq 150.$$

The above formula represents an index of the hardness of the overall core enclosure composed of the intermediate layer and the cover. If this index is smaller than the above-indicated range in values, the spin rate-lowering effect of the core will readily emerge on shots taken with an iron but will be more than offset by the spin rate-increasing effect of the cover, resulting in an increase in the spin rate of the ball. On the other hand, if the index is larger than the above-indicated range in values, the spin rate-lowering effect of the core on shots taken with an iron will not readily emerge and the spin rate of the ball will rise. As a result, the distance traveled by the ball will decrease and the feel on impact will be harder.

The method of producing the golf ball of the invention is not subject to any particular limitation. Both the intermediate layer and the cover may be formed by a suitable process such as injection molding or compression molding. When injection molding is employed, the process may involve placing a prefabricated solid core at a predetermined position in an injection molding mold, then introducing the above-described material into the mold. When compression molding is employed, the process may involve producing a pair of half cups from the above-described material, enclosing the core with these cups, either directly or over an intervening intermediate layer, then applying heat and pressure within a mold.

In the practice of the invention, a golf ball composed of a core, an intermediate layer encasing the core, and a cover encasing the intermediate layer is formed using the respective above-described materials. In addition, the initial velocity of the core and the initial velocity of the golf ball may be optimized.

The aforementioned core and ball initial velocities (m/s) are measured values obtained using an initial velocity measuring apparatus of the same type as the USGA drum rotation-type initial velocity instrument approved by the R&A. The ball is temperature-conditioned for at least 3 hours in a 23±1° C. environment, then tested in a 23±2° C. chamber by being hit with a 250 pound (113.4 kg) head (striking mass) at an impact velocity of 143.8 ft/s (43.83 m/s). One dozen balls are each hit four times. The time taken for the ball to traverse a distance of 6.28 ft (1.91 m) is measured and used to compute the initial velocity (m/s) of the ball. This cycle is carried out over a period of about 15 minutes.

Here, it is preferable to set the difference expressed by the formula $$(\text{initial velocity of core}) - (\text{initial velocity of ball})$$

to a value less than 0, preferably −0.2 or below, and more preferably −0.4 or below. For the ball to have a higher initial velocity than the core means that the intermediate layer and the cover have a good resilience. A good near-surface resilience when the ball is hit with an iron will tend to increase the initial velocity of the ball on impact, whereas a poor near-surface resilience will increase the period of contact when the ball is hit with an iron, which may make the ball feel heavy on impact. Therefore, the advantageous effects of the invention can be fully achieved by providing the ball with a higher initial velocity than the core.

The golf ball has a deflection when compressed under a final load of 130 kgf from an initial load of 10 kgf which, while not subject to any particular limitation, is preferably at least 2.5 mm, and more preferably at least 2.8 mm. The upper limit value is preferably not more than 4.0 mm, and more preferably not more than 3.5 mm. If this value is too small—that is, if the ball is too hard—the core deformation on shots with an iron will be inadequate, as a result of which a spin-lowering effect may not arise and the feel on impact may be too hard. Conversely, if the ball is too soft, deformation by the ball on impact with a driver may be excessive, resulting in a poor rebound.

The golf ball of the invention may be formed to a diameter of generally at least 42.67 mm, and preferably from 42.67 to 43.00 mm, and to a weight of generally from 45.0 to 45.93 g. Moreover, to achieve the objects of the invention, it is desirable for the inventive golf ball to comply with the 2006 R&A Rules of Golf. Specifically, it is desirable for the golf ball to: (1) not pass through a ring having an inside diameter of 42.672 mm, (2) have a weight of not more than 45.93 g, and (3) have an initial velocity of not more than 77.724 m/s.

As explained above, the present invention provides a multi-piece solid golf ball which achieves a fully acceptable distance on shots taken with a driver and which also has an improved feel on impact and distance on shots taken with a middle iron or a long iron, and is thus advantageous for golfers.

EXAMPLES

Examples of the invention and Comparative Examples are given below by way of illustration, and not by way of limitation.

Examples 1 to 4, Comparative Examples 1 to 9

Rubber materials formulated as shown in Table 1 below were prepared for the production of the golf balls in Examples 1 to 4 of the invention and Comparative Examples 1 to 9. These rubber compositions were suitably masticated with a kneader or roll mill, then vulcanized at 155° C. for 15 minutes to form solid cores. Numbers shown for each material in the table indicate parts by weight.

TABLE 1

| Core formulation | | A | B | C | D | E | F |
|---|---|---|---|---|---|---|---|
| Polybutadiene[1)] | | 100 | 100 | 100 | 100 | 100 | 100 |
| Zinc acrylate | | 34.4 | 32.6 | 30.8 | 29.0 | 35.3 | 25.0 |
| Peroxide (1)[2)] | | 0 | 0 | 0 | 0 | 0 | 0.6 |
| Peroxide (2)[3)] | | 3 | 3 | 3 | 3 | 3 | 0.6 |
| Sulfur[4)] | | 0.1 | 0.1 | 0.1 | 0.1 | 0.1 | 0 |
| Antioxidant[5)] | | 0 | 0 | 0 | 0 | 0 | 0.1 |
| Zinc oxide | | 26.2 | 26.9 | 27.6 | 28.3 | 25.7 | 29.6 |
| Zinc salt of pentachlorothiophenol | | 0.5 | 0.5 | 0.5 | 0.5 | 1.5 | 0.2 |
| Vulcanization method | Temperature (° C.) | 155 | 155 | 155 | 155 | 155 | 155 |
| | Time (minutes) | 15 | 15 | 15 | 15 | 15 | 15 |

The above materials are described below. The numbers indicated above represent parts by weight.
[1)]Polybutadiene rubber: BR01 (trade name), available from JSR Corporation.
[2)]Peroxide (1): Dicumyl peroxide, available from NOF Corporation under the trade name Percumyl D.
[3)]Peroxide (2): A mixture of 1,1-di(t-butylperoxy)cyclo-hexane and silica, available from NOF Corporation under the trade name Perhexa C-40.
[4)]Sulfur: Zinc white-sulfur mixture, available from Tsurumi Chemical Industry Co., Ltd.
[5)]Antioxidant: Nocrac NS-6 (trade name), available from Ouchi Shinko Chemical Industry Co., Ltd.

Next, the intermediate layer materials shown in Table 2 below were injection-molded over the above cores, thereby forming intermediate layer-covered bodies. The covers shown in Table 3 were then injection-molded over the surfaces of these intermediate layer-covered bodies, thereby forming three-piece solid golf balls.

TABLE 2

Intermediate Layer Material Formulations

| Component | Grade | a | b | c | d | e | f |
|---|---|---|---|---|---|---|---|
| Ionomer | AM7318 | | | | 65 | | |
| | S8150 | | | | | 65 | |
| | S8120 | | 40 | 75 | | | 75 |
| | S8320 | 75 | 35 | | | | |
| Thermoplastic elastomer | DR6100P | 25 | 25 | 25 | 35 | 35 | 25 |
| Fatty acid | Behenic acid | 20 | 20 | 20 | 20 | 20 | |
| Cation source | $Ca(OH)_2$ | 2.3 | 2.3 | 2.3 | 2.4 | 2.4 | |

Note:
Numbers for the respective components indicate parts by weight.
AM7318: An ionomer resin which is an ethylene-methacrylic acid copolymer neutralized with sodium ions. Available from DuPont-Mitsui Polychemicals Co., Ltd.
S8150: An ionomer resin which is an ethylene-methacrylic acid copolymer neutralized with sodium ions. Available from E.I. DuPont de Nemours & Co.
S8120: An ionomer resin which is an ethylene-methacrylic acid-acrylic acid ester copolymer neutralized with sodium ions. Available from E.I. DuPont de Nemours & Co.

TABLE 2-continued

Intermediate Layer Material Formulations

| Component | Grade | a | b | c | d | e | f |
|---|---|---|---|---|---|---|---|

S8320: An ionomer resin which is an ethylene-methacrylic acid-acrylic acid ester copolymer neutralized with sodium ions. Available from E.I. DuPont de Nemours & Co.
DR6100P: A hydrogenated polymer (olefin-based thermoplastic elastomer) available from JSR Corporation.
Behenic acid: NAA-222S (trade name), available from NOF Corporation as a powder.
$Ca(OH)_2$: CLS-B (trade name), available from Shiraishi Calcium Kaisha, Ltd.

TABLE 3

Cover Material Formulations

| Component | Grade | g | h | i | j | k |
|---|---|---|---|---|---|---|
| Ionomer | H1605 | | | 35 | | 40 |
| | H1706 | | | | | 50 |
| | H1601 | | | | 50 | 10 |
| | H1557 | 10 | 30 | 35 | 50 | |
| | AM7331 | 50 | 50 | 15 | | |
| | H1855 | 40 | 20 | 15 | | |
| Additives | Titanium oxide ($TiO_2$) | 4 | 4 | 4 | 4 | 4 |
| | Blue | 0.04 | 0.04 | 0.04 | 0.04 | 0.04 |
| Fatty acid | Behenic cid | 20 | 20 | 20 | 20 | 20 |
| Cation source | $Ca(OH)_2$ | 2.6 | 2.6 | 2.6 | 2.6 | 2.6 |

Note:
Numbers for the respective components indicate parts by weight.
H1605: An ionomer resin which is an ethylene-methacrylic acid copolymer neutralized with sodium ions. Available from DuPont-Mitsui Polychemicals Co., Ltd.
H1706: An ionomer resin which is an ethylene-methacrylic acid copolymer neutralized with zinc ions. Available from DuPont-Mitsui Polychemicals Co., Ltd.
H1601: An ionomer resin which is an ethylene-methacrylic acid copolymer neutralized with sodium ions. Available from DuPont-Mitsui Polychemicals Co., Ltd.
H1557: An ionomer resin which is an ethylene-methacrylic acid copolymer neutralized with zinc ions. Available from DuPont-Mitsui Polychemicals Co., Ltd.
AM7331: An ionomer resin which is an ethylene-methacrylic acid-acrylic acid ester copolymer neutralized with sodium ions. Available from DuPont-Mitsui Polychemicals Co., Ltd.
H1855: An ionomer resin which is an ethylene-methacrylic acid-acrylic acid ester copolymer neutralized with zinc ions. Available from DuPont-Mitsui Polychemicals Co., Ltd.
Behenic acid: NAA-222S (trade name), available from NOF Corporation as a powder.
$Ca(OH)_2$: CLS-B (trade name), available from Shiraishi Calcium Kaisha, Ltd.
Titanium oxide: Tipaque R550 (trade name), available from Ishihara Sangyo Kaisha, Ltd.
Ultramarine Blue EP-62: Available from Holliday Pigments.

The structures and performance evaluations for the above three-piece solid golf balls are summarized below.

TABLE 4

| | | Example | | | |
|---|---|---|---|---|---|
| | | 1 | 2 | 3 | 4 |
| Core | Diameter (mm) | 37.9 | 37.9 | 37.5 | 38.3 |
| | Formulation | B | D | C | B |
| | Deflection (mm) | 3.6 | 4.0 | 3.8 | 3.6 |
| | Initial velocity (m/s) | 77.2 | 77.1 | 77.1 | 77.2 |
| | Center hardness (JIS-C) | 60 | 57 | 59 | 60 |
| | Surface hardness (JIS-C) | 85 | 81 | 83 | 85 |
| | Surface - center (JIS-C) | 25 | 24 | 24 | 25 |

TABLE 4-continued

| | | | Example | | | |
|---|---|---|---|---|---|---|
| | | | 1 | 2 | 3 | 4 |
| Intermediate layer | | Sphere diameter (mm) | 40.3 | 40.3 | 40.1 | 40.b;normal5 |
| | | Thickness (mm) | 1.2 | 1.2 | 1.3 | 1.1 |
| | | Hardness (Shore D) | 51 | 51 | 51 | 58 |
| | | Formulation | c | c | c | d |
| Cover | | Sphere diameter (mm) | 42.7 | 42.7 | 42.7 | 42.7 |
| | | Weight (g) | 45.5 | 45.5 | 45.4 | 45.6 |
| | | Thickness (mm) | 1.2 | 1.2 | 1.3 | 1.1 |
| | | Hardness (Shore D) | 58 | 58 | 58 | 58 |
| | | Formulation | i | i | i | i |
| Ball | | Deflection (mm) | 3.0 | 3.3 | 3.0 | 3.0 |
| | | Initial velocity (m/s) | 77.4 | 77.2 | 77.3 | 77.4 |
| Intermediate layer/cover hardness formula[1)] | | | 131 | 131 | 142 | 128 |
| (Initial velocity of core) − (initial velocity of ball) (m/s) | | | −0.2 | −0.1 | −0.2 | −0.2 |
| Flight performance | Driver #1 HS45 | Spin rate (rpm) | 2560 | 2510 | 2500 | 2550 |
| | | Initial velocity (m/s) | 62.6 | 62.2 | 62.4 | 62.5 |
| | | Distance (m) | 229.5 | 228.8 | 230.6 | 229.3 |
| | Iron I#6 | Spin rate (rpm) | 5620 | 5570 | 5690 | 5670 |
| | | Initial velocity (m/s) | 55.0 | 55.2 | 55.0 | 54.9 |
| | | Distance (m) | 179.4 | 181.3 | 179.2 | 178.5 |
| Feel on impact | | Driver | soft | soft | soft | soft |
| | | Iron | soft | soft | soft | soft |
| Durability to cracking | | | good | good | good | good |

Notes:
[1)](D hardness of intermediate layer × thickness of intermediate layer) + (D hardness of cover × thickness of cover)

TABLE 5

| | | | Comparative Example | | | | | | | | |
|---|---|---|---|---|---|---|---|---|---|---|---|
| | | | 1 | 2 | 3 | 4 | 5 | 6 | 7 | 8 | 9 |
| Core | | Diameter (mm) | 37.9 | 38.3 | 37.5 | 37.9 | 37.9 | 37.9 | 37.9 | 35.7 | 37.9 |
| | | Formulation | F | A | C | A | C | A | C | C | E |
| | | Deflection (mm) | 3.6 | 3.4 | 3.8 | 3.4 | 3.8 | 3.4 | 3.8 | 3.8 | 3.6 |
| | | Initial velocity (m/s) | 77.2 | 77.2 | 77.1 | 77.2 | 77.1 | 77.2 | 77.2 | 77.2 | 77.7 |
| | | Center hardness (JIS-C) | 63 | 61 | 59 | 60 | 59 | 59 | 59 | 59 | 60 |
| | | Surface hardness (JIS-C) | 77 | 86 | 83 | 85 | 83 | 83 | 83 | 83 | 85 |
| | | Surface - center (JIS-C) | 14 | 25 | 24 | 25 | 24 | 24 | 24 | 24 | 25 |
| Intermediate layer | | Sphere diameter (mm) | 40.3 | 40.5 | 40.1 | 40.3 | 40.3 | 40.3 | 40.3 | 39.2 | 40.3 |
| | | Thickness (mm) | 1.2 | 1.1 | 1.3 | 1.2 | 1.2 | 1.2 | 1.2 | 1.75 | 1.2 |
| | | Hardness (Shore D) | 51 | 47 | 58 | 42 | 62 | 51 | 51 | 51 | 51 |
| | | Formulation | c | b | d | a | e | c | c | c | f |
| Cover | | Sphere diameter (mm) | 42.7 | 42.7 | 42.7 | 42.7 | 42.7 | 42.7 | 42.7 | 42.7 | 42.7 |
| | | Weight (g) | 45.5 | 45.6 | 45.4 | 45.5 | 45.5 | 45.5 | 45.5 | 45.1 | 45.5 |
| | | Thickness (mm) | 1.2 | 1.1 | 1.3 | 1.2 | 1.2 | 1.2 | 1.2 | 1.75 | 1.2 |
| | | Hardness (Shore D) | 58 | 53 | 60 | 58 | 58 | 51 | 63 | 58 | 58 |
| | | Formulation | i | h | j | i | i | g | k | i | i |
| Ball | | Deflection (mm) | 3.0 | 3.0 | 3.0 | 3.0 | 3.0 | 3.0 | 3.0 | 3.0 | 3.0 |
| | | Initial velocity (m/s) | 77.4 | 77.25 | 77.4 | 77.3 | 77.4 | 77.25 | 77.5 | 77.3 | 77.3 |
| Intermediate layer/ cover hardness formula[1)] | | | 131 | 110 | 153 | 120 | 144 | 122 | 137 | 191 | 131 |
| (Initial velocity of core) − (initial velocity of ball) (m/s) | | | −0.2 | −0.05 | −0.3 | −0.1 | −0.3 | −0.05 | −0.3 | −0.1 | 0.4 |
| Flight performance | Driver #1 HS45 | Spin rate (rpm) | 2720 | 2630 | 2480 | 2660 | 2550 | 2820 | 2530 | 2750 | 2580 |
| | | Initial velocity (m/s) | 62.5 | 62.5 | 62.3 | 62.3 | 62.5 | 62.2 | 62.7 | 62.4 | 62.5 |
| | | Distance (m) | 227.0 | 227.4 | 230.4 | 227.2 | 229.2 | 226.1 | 231.1 | 226.7 | 229.2 |
| | Iron I#6 | Spin rate (rpm) | 5780 | 5870 | 5770 | 5780 | 5610 | 5880 | 5760 | 5810 | 5610 |
| | | Initial velocity (m/s) | 55.1 | 55.0 | 55.1 | 54.9 | 55.1 | 55.0 | 55.1 | 55.2 | 54.6 |
| | | Distance (m) | 177.3 | 175.2 | 176.1 | 176.0 | 180.2 | 176.8 | 177.2 | 176.6 | 176.3 |
| Feel on impact | | Driver | ordinary | soft | ordinary | soft | ordinary | soft | ordinary | hard | soft |
| | | Iron | soft | soft | hard | soft | ordinary | soft | hard | ordinary | ordinary |
| Durability to cracking | | | good | good | fair | good | NG | good | fair | good | good |

Notes:
[1)](D hardness of intermediate layer × thickness of intermediate layer) + (D hardness of cover × thickness of cover)

Performance evaluations of each ball were carried out by the test methods described below.

Deflection (1) Deformation (mm) by the core when compressed under a final load of 1,275 N (130 kgf) from an initial load state of 98 N (10 kgf) was measured.

(2) Deformation (mm) by the ball sphere when compressed under a final load of 1,275 N (130 kgf) from an initial load state of 98 N (10 kgf) was measured.

JIS-C Hardnesses at Core Surface and Core Center

The hardness at the core surface was determined by setting the durometer indenter perpendicular to the spherical surface of the core, and carrying out measurement in accordance with the JIS-C hardness standard. The hardness at the center of the core was determined by cutting the core into two halves, and measuring the hardness at the center portion of the cut face in accordance with the JIS-C hardness standard.

Shore D Hardnesses of Intermediate Layer and Cover (Material Hardness)

The cover composition was formed under applied heat and pressure to a thickness of about 2 mm, and the resulting sheet was held at 23° C. for 2 weeks, following which the hardness was measured in accordance with ASTM D-2240.

Initial Velocity of Ball

The initial velocity of the spherical object (ball or core) was measured using an initial velocity measuring apparatus of the same type as the USGA drum rotation-type initial velocity instrument approved by the R&A. The ball was temperature conditioned in a 23±1° C. environment for at least 3 hours, then tested in a chamber at a room temperature of 23±2° C. The ball was hit using a 250-pound (113.4 kg) head (striking mass) at an impact velocity of 143.8 ft/s (43.83 m/s). One dozen balls were each hit four times. The time taken by the ball to traverse a distance of 6.28 ft (1.91 m) was measured and used to compute the initial velocity (m/s) of the ball. This cycle was carried out over a period of about 15 minutes.

Flight Performance (1) The distance traveled by the ball when hit at a head speed (HS) of 45 m/s with a driver (TourStage X-Drive Type 405, manufactured by Bridgestone Sports Co., Ltd.; loft angle, 9.5°) mounted on a swing robot (Miyamae Co., Ltd.) was measured. The initial velocity and spin rate were measured from high-speed camera images of the ball taken immediately after impact.

(2) The distance traveled by the ball when hit at a head speed (HS) of 45 m/s with an iron (TourStage New X-Blade CB I#6, manufactured by Bridgestone Sports Co., Ltd.) mounted on a swing robot (Miyamae Co., Ltd.) was measured. The initial velocity and spin rate were measured from high-speed camera images of the ball taken immediately after impact.

Feel on Impact

Each ball was hit by five skilled amateur golfers having handicaps of less than 10 and assigned a score of 1 to 5 according to the following criteria.

5: Very soft
4: Soft
3: Ordinary
2: Hard
1: Very hard

The scores obtained for each ball were then averaged, based on which the feel of the ball was assigned one of the three ratings indicated below.

Soft: Average score for the five golfers was above 4
Ordinary: Average score for the five golfers was from 2 to 4
Hard: Average score for the five golfers was below 2

Durability to Cracking

The ball was repeatedly hit at a head speed of 40 m/s with a number one wood (W#1) club mounted on a golf swing robot. The durability to cracking was evaluated by determining the number of shots that had been taken with a ball when cracks began to form on the surface of the ball. The average value for N=3 balls was used as the basis for evaluation in each example. The number of shots that had been taken with the ball in Example 2 when the initial velocity fell below 97% of the average initial velocity for the first 10 shots was assigned a durability index of "100", and indices for the balls in the other examples were rated as follows.

Good: Durability index was 110 or more
Fair: Durability index was at least 90 but less than 110
NG: Durability index was less than 90

As described below, it is apparent from the results in Table 5 that the golf balls in each of the comparative examples had a ball performance that was inferior compared with that of the golf balls in the examples according to the invention.

In Comparative Example 1, because the core had a small hardness distribution, on shots taken with a number one wood (W#1) and a number six iron (I#6), the spin rate was high and the feel on impact was hard.

In Comparative Example 2, the small value of the above hardness formula (Note 1 of Table 5) resulted in a high spin rate and thus a poor distance, both on shots with a W#1 and on shots with an I#6.

In Comparative Example 3, the large value of the above hardness formula (Note 1 of Table 5) resulted in a high spin rate and thus a poor distance on shots with a I#6. Moreover, the feel of the ball on shots taken with an iron was hard.

In Comparative Example 4, the intermediate layer was too soft, resulting in a high spin rate and thus a poor distance on shots with an I#6.

In Comparative Example 5, the intermediate layer was too hard, resulting in a hard feel, both on shots with a W#1 and on shots with an I#6. Moreover, the durability to cracking was poor.

In Comparative Example 6, the cover was too soft, resulting in a high spin rate, both on shots with a W#1 and on shots with an I#6, and thus a poor distance.

In Comparative Example 7, the cover was too hard, resulting in a hard feel, both on shots with a W#1 and on shots with an I#6. Moreover, the spin rate on shots with an I#6 was high, resulting in a poor distance.

In Comparative Example 8, the small core and the large value of the above hardness formula (Note 1 of Table 5) resulted in a high spin rate and thus a poor distance, both on shots with a W#1 and on shots with an I#6. Moreover, the ball had a hard feel on impact.

In Comparative Example 9, the cover had a poor resilience and the initial velocity on shots with an I#6 did not rise, resulting in a poor distance. Moreover, on shots with an iron, the contact time with the club was long, making the ball feel heavy on impact.

The invention claimed is:

1. A multi-piece solid golf ball comprising a rubber-based core encased by, in order, an intermediate layer and a cover, wherein the core contains from 0.05 to 0.5 part by weight of sulfur per 100 parts by weight of the rubber base, has a hardness difference between a surface and a center of the core, expressed in JIS-C hardness units, of at least 21 but not more than 30, and has a diameter of from 36 to 40 mm, the surface hardness of the core is at least 75 but not more than 90 as expressed in JIS-C hardness units; the intermediate layer has a Shore D hardness of at least 47 but not more than 60, and a thickness of from 0.5 to 2.0 mm; the cover has a Shore D hardness of at least 53 but not more than 59, and a thickness of from 0.6 to 1.5 mm; and the intermediate layer and cover satisfy the following condition:

$$120 \leq (\text{Shore } D \text{ hardness of intermediate layer} \times \text{thickness of intermediate layer}) + (\text{Shore } D \text{ hardness of cover} \times \text{thickness of cover}) \leq 150.$$

2. The multi-piece solid golf ball of claim 1 which has a difference between core initial velocity and ball initial velocity, as measured by a method set forth in the Rules of Golf using an initial velocity measuring apparatus of the same type as the USGA drum rotation-type initial velocity instrument, which satisfies the condition:

$$(\text{initial velocity of core}) - (\text{initial velocity of ball}) < 0.$$

3. The multi-piece solid golf ball of claim 1, wherein the intermediate layer and/or the cover is made of a heated mixture which is composed of:

(a) 100 parts by weight of an olefin-unsaturated carboxylic acid random copolymer and/or an olefin-unsaturated carboxylic acid-unsaturated carboxylic acid ester random copolymer, (b) from 5 to 80 parts by weight of a fatty acid and/or fatty acid derivative having a molecular weight of at least 280, and (c) from 0.1 to 10 parts by weight of a basic inorganic metal compound capable of neutralizing the acid groups in components (a) and (b), and which has a melt index of at least 1.0 dg/min.

4. The multi-piece solid golf ball of claim 1, wherein the intermediate layer and/or the cover is made of a heated mixture which is composed of:

(d) 100 parts by weight of a metal ion neutralization product of an olefin-unsaturated carboxylic acid random copolymer and/or an olefin-unsaturated carboxylic acid-unsaturated carboxylic acid ester random copolymer, (b) from 5 to 80 parts by weight of a fatty acid and/or fatty acid derivative having a molecular weight of at least 280, and (c) from 0.1 to 10 parts by weight of a basic inorganic metal compound capable of neutralizing the acid groups in components (d) and (b), and which has a melt index of at least 1.0 dg/min.

5. The multi-piece solid golf ball of claim 1, wherein the intermediate layer and/or the cover is made of a heated mixture which is composed of:

100 parts by weight of, in admixture, (a) an olefin-unsaturated carboxylic acid random copolymer and/or an olefin-unsaturated carboxylic acid-unsaturated carboxylic acid ester random copolymer and (d) a metal ion neutralization product of an olefin-unsaturated carboxylic acid random copolymer and/or an olefin-unsaturated carboxylic acid-unsaturated carboxylic acid ester random copolymer, (b) from 5 to 80 parts by weight of a fatty acid and/or fatty acid derivative having a molecular weight of at least 280, and (c) from 0.1 to 10 parts by weight of a basic inorganic metal compound capable of neutralizing the acid groups in components (a), (d) and (b), and which has a melt index of at least 1.0 dg/min.

6. The multi-piece solid golf ball of claim 1, wherein the core has a deflection when compressed under a final load of 1,275 N (130 kgf) from an initial load of 98 N (10 kgf) of from 3.0 to 4.5 mm.

7. The multi-piece solid golf ball of claim 1, wherein the center hardness of the core is at least 50 but not more than 65 as expressed in JIS-C hardness units.

* * * * *